United States Patent [19]

Quetsch et al.

[11] Patent Number: 4,872,404

[45] Date of Patent: Oct. 10, 1989

[54] PRESS FOR EXPRESSING LIQUIDS FROM SUBSTANCES CONTAINING THEM, ESPECIALLY MUSTS

[75] Inventors: Karl-Heinz Quetsch, Mühlenstr; Hennig Vetter, Trottstr, both of Fed. Rep. of Germany

[73] Assignee: Vetter Maschinenfabrik GmbH, Fed. Rep. of Germany

[21] Appl. No.: 120,492

[22] Filed: Nov. 12, 1987

[30] Foreign Application Priority Data

Nov. 13, 1986 [DE] Fed. Rep. of Germany ..... 3638839

[51] Int. Cl.[4] ..... B30B 9/02; B30B 9/22; B30B 9/26

[52] U.S. Cl. ..... 100/125; 99/495; 100/110; 100/177; 100/211; 210/396; 210/401

[58] Field of Search ..... 100/121, 110, 125–127, 100/131, 134, 120, 177, 211, 212, 178; 99/458, 465, 495; 210/386, 391, 395, 397, 400, 401

[56] References Cited

U.S. PATENT DOCUMENTS

| | | | |
|---|---|---|---|
| 2,631,527 | 3/1953 | Mack | 100/125 |
| 4,513,659 | 4/1985 | Braun | 100/211 X |
| 4,517,087 | 5/1985 | Magase et al. | 99/495 X |

FOREIGN PATENT DOCUMENTS

| | | |
|---|---|---|
| 0188213 | 1/1957 | Austria . |
| 0076932 | 4/1983 | European Pat. Off. . |
| 0097894 | 1/1984 | European Pat. Off. . |
| 566820 | 12/1932 | Fed. Rep. of Germany . |
| 3137355 | 4/1983 | Fed. Rep. of Germany . |
| 3224087 | 12/1983 | Fed. Rep. of Germany . |
| 3436388 | 4/1986 | Fed. Rep. of Germany . |
| 3440558 | 5/1986 | Fed. Rep. of Germany . |

*Primary Examiner*—Timothy F. Simone

[57] ABSTRACT

A press for expressing liquids from liquid-containing substances, especially musts, contains an at least partially cylindrical sieve wall and a pressing apparatus disposed therein which has a rotatable shaft and separators radially fastened to the latter which form a plurality of press chambers. These are separated by a radially acting pressing means into a pressure chamber and a press chamber. To fill and empty the press chambers a charging station and a discharge station are provided. The sieve wall is stationary and the pressure chambers are sealed hermetically one from the other. Lastly, means are provided for rotating the shaft step-wise and thereby placing the press chambers step-wise successively at the charging station and at the discharge station.

16 Claims, 6 Drawing Sheets

PRESS FOR EXPRESSING LIQUIDS FROM SUBSTANCES CONTAINING THEM, ESPECIALLY MUSTS

BACKGROUND OF THE INVENTION

The invention relates to a press for pressing out liquid-containing substances, especially musts. More specifically, it relates to a press of this type having: an at least partially cylindrical sieve wall; a pressing means disposed within the sieve wall which has a rotatable shaft with radial dividers to form a plurality of press chambers in which radially acting press means are disposed which divide the press chambers each into a pressure chamber and a press chamber open radially outwardly. There is also a charging station and a discharge station; and means for controlling the pressure in the pressure chambers for the timed radial forward pressing of the pressing means.

Presses of this kind are known in a variety of embodiments (German Federal Patent Nos. 27 14 184, 29 45 254 and 31 37 355). They permit a gentle expression of the liquids, but they all operate discontinuously. This means that first their working containers, press chambers or the like must be filled with the material, then the material must be pressed, and finally the remaining residue must be removed again from all of the press chambers. Thus on the one hand the performance, i.e., the throughput of material, is not always sufficiently high, while on the other hand automation of the overall pressing process is virtually impossible. Better performance could be achieved only by enlarging the press chambers, but this would involve a disproportionately high expenditure of material and costs, which is possible only within certain limits, and therefore is rejected for practical reasons.

In a known press which operates largely in a continuous or automatic manner (German Fed. Pat. No. 32 24 086) a press element in the form of a flexible membrane impervious to liquid is drawn onto a conveyor screw. Such presses have not proven practical mainly on account of constructional problems.

The invention is addressed to the object of permitting a largely continuous or automatic processing of the material even in a press of the kind referred to above, without having to sacrifice the advantage of the conventional membrane presses.

SUMMARY OF THE INVENTION

This object is obtained by: disposing the sieve wall stationarily, sealing the pressure chambers leak-proof against one another, and by providing means for the step-wise rotation of the shaft in order to place the press chambers step-wise at the charging station and discharge station.

The invention offers the advantage that, despite simple construction, a largely continuous and automatic processing of the material is possible. It is advantageous furthermore that within the individual press chambers different pressures can be provided and the pressure can be adapted in a simple manner in every pressing step to the conditions necessary in the individual case. Thus an especially gentle pressing of any material is possible, with the production of optimum quantities.

BRIEF DESCRIPTION OF THE DRAWING

The invention will be further explained below by means of embodiments in conjunction with the appended drawing, wherein.

DESCRIPTION OF PREFERRED EMBODIMENTS

Figure 1:
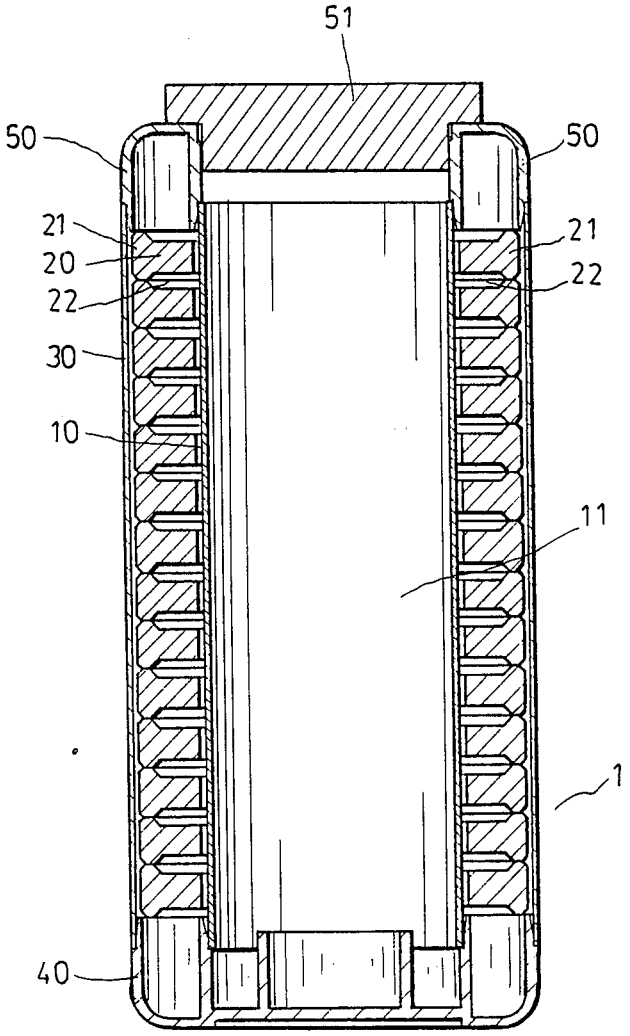
FIGS. 1 to 3 are diagrammatic longitudinal sections through three embodiments of the press according to the invention.

The embodiment of the press according to the invention that is represented in FIG. 1 has a machine frame 1 on which a housing 2 for a conveyor screw 3 and a substantially cylindrical sieve wall 4 are mounted. On the housing is mounted a hopper 5 whose bottom opens into an opening in the housing 2. The hopper 5 can be a plain gravity hopper. It is also possible, however, to dispose a grinder or the like inside of the hopper 5 for the purpose of grinding or otherwise preparing the material for the pressing process, which material is indicated by the reference number 6 and represented by dots. The bottom of the housing 2 is preferably in the form of a sieve 7 under which a collecting trough 8 is disposed.

The conveyor screw 3 lies axially below the hopper 5 with its axis disposed horizontally. Its one end is provided with a stubshaft 10 which is rotatably mounted in a column 11 of the machine frame 1 also holding the housing 2, and which is provided on its end projecting from the column 11 with a gear 12 which can be made to rotate by a drive which is not represented. The other end of the conveyor screw 3 extends into a filling chamber 14 disposed at the corresponding end of the housing 2 and the conveyor screw 3 and the housing 2 forms a charging station together with the hopper 4.

A substantially star-shaped carrier body 15 is mounted for rotation in the stationary sieve wall 4 and extends substantially over the entire axial length of the sieve wall 4. The carrier body 15 is provided at its axial ends with end plates which are fastened on a shaft 16 which is journaled on the machine frame 1 and can be made to rotate by a drive which is not shown, its axis of rotation being perpendicular to the shaft 9 but being preferably disposed also horizontally. The rotation is performed in the direction of the arrow, i.e., clockwise. The carrier body 15 consists preferably of a cylindrical drum which is provided on its outer circumference with radially projecting, axially parallel dividers 17 which form a plurality of cup-like press chambers **18*a* to 18*h* open outwardly and distributed on the circumference of the carrier body 15 with their ends reaching nearly to the sieve wall 4. All of the press chambers 18 have preferably the same distance between centers measured circumferentially of the axis 16, and are of equal width. In the rotational position of the carrier body 15 seen in FIG. 1, each press chamber 18*a* and 18*h* is just opposite an opening in the sieve wall, while all other press chambers 18*b* to 18*g* are covered by the sieve wall. The one opening in the sieve wall 4 leads into the charging chamber 14 while the other opening in the sieve wall 4 constitutes a discharging station in the form of a discharge opening 19. The sieve wall 4 could also be constructed as a three-quarter cylinder and could be joined in a different manner to the charging chamber 14 or the discharge opening 19**.

All of the press chambers 18*a* to 18*h* are provided with pressing means, e.g. flexible or rubber-elastic membranes 20 which are affixed to the dividers 17. These membranes 20 are preferably of such a size that they can lie in one end position against the bottom of their press chambers, as is indicated at press chamber 18*a*, but in the other end position they can reach approximately to the surrounding sieve wall 4, as seen in the case of the membrane 20 in the press chamber 18*g* in FIG. 1. Each membrane 20 divides the press chamber 18*a* to 18*h* associated with it into a pressure chamber 21 and a press chamber 22 in which the material being pressed 6 is situated. The membranes 20 are joined to the dividers 17 such that an impermeable seal, i.e., a seal impervious to the pressurizing air or liquid medium, is produced, and any of this medium fed into any pressure chamber 21 will remain restricted to this pressure chamber, i.e., will be unable to pass over to any of the other pressure chambers. The individual dividers 17 also reach so close to the inside of the sieve wall 4 that, upon the rotation of the shaft 16 and carrier body 15, they will carry with them the material situated in any press chamber 22 and the material will be unable to pass into any other press chamber.

Underneath the sieve wall 4 there is disposed an additional collecting trough 23 in which the liquid passing through the sieve wall 4 in the pressing process is collected, as is indicated by arrows 24 in FIG. 1. Otherwise, the portion of sieve wall 4 that is situated between the charging chamber 14 and the discharge opening can be surrounded with an outside wall 25 disposed at a distance from it.

Compressed air, for example, is used as the pressure medium, although any other gas or a liquid could serve as the pressure medium. The pressure is produced by means of a pressure generator not shown, e.g., a compressor or a pump, connected to the individual pressure chambers 21 by conduits and valves that are not shown.

The machine frame 1 is preferably mounted on wheels, not shown, so that the entire press is transportable, as is desired especially for the processing of grapes at harvest time in vineyards.

The hopper 5 is preferably of the size that is necessary for a continuous or step-wise and automatic processing of the material 6. Furthermore, the hopper 5 leads into the housing 2 largely at the entrance end of the conveyor screw 3, so that when the latter is rotated the material 6 is conveyed along the housing 2 to the charging chamber 14. A considerable part of the liquid in the material 6 therefore separates even while it is being conveyed and drips through the bottom of housing 2 into the collecting trough 8, even if it is conveyed largely without any pressure and therefore is treated gently. This gives the important advantage that the mass or volume of the material is considerably reduced right in the conveyor screw 3 and therefore substantially smaller press chambers 18 can be provided, e.g., about 50% smaller, for the working of a particular amount of material 6, than would be possible if the conveyor screw 3 were not present. This markedly increases the output of the press in the case of substances which can be dewatered previously with little or no pressure.

The described press is suited to the pressing of a great number of liquid-containing substances, especially agricultural and chemical products. Just by way of example, the pressing of grapes in wine making or of fruits in the production of fruit juices, in which the material is in the form of a must or mash and the residue discharged through opening 19 is referred to as marc. But other liquid-containing substances such as mash of any kind of grain, gluten from wheat and corn, and pulps of potatoes, cassava, manioc, tapioca etc., as produced in the brewing of beer or the manufacture of starch, can be worked with the described press. The same applies to the dewatering of sauerkraut or kieselgur, and all the examples of application of the press described are not intended in any way to express limitation.

Figure 2:
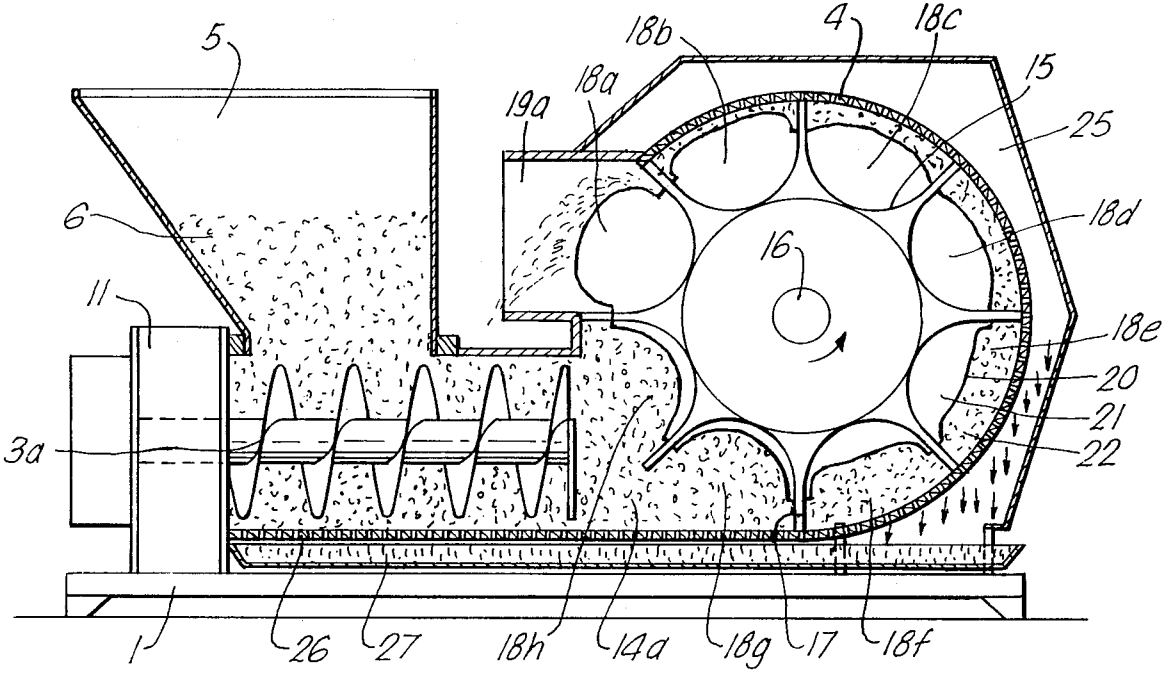

The embodiment according to FIG. 2 differs essentially only in the position of the conveyor screw 3*a*, of the charging chamber 14*a* and of the discharge opening 19*a*, from the embodiment shown in FIG. 1. For this reason most of the rest of the components are given the same reference numbers as in FIG. 1. Since, in contrast to FIG. 1, the conveyor screw 3*a* is disposed directly on the bottom of the machine frame 1, the sieve wall 4 is extended substantially over only five instead of six of the eight press chambers 18, so that the two press chambers 18*h* and 18*g* are situated at the charging chamber 14*a*, while the press chamber 18*a* is opposite the discharge opening 19*a* disposed above the charging chamber 14*a*. In additional contrast to FIG. 1, the rotation of the carrier body 15 is counterclockwise, as indicated by the arrow. Lastly, the cylindrical portion of the sieve wall 4 terminates at the divider 17 separating the press chambers 18*f* and 18*g*. This point is then followed by a substantially flat sieve wall section 26 disposed parallel to the machine frame 1 and reaching all the way to the standard 11. It is thus possible to provide a collecting trough running from the standard 11 to the sieve wall 4.

FIGS. 3 to 6 show an additional variant in regard to the position and arrangement of a conveyor screw 31 as well as additional details of the entire press which are present in the same or a similar manner also in the embodiments according to FIGS. 1 and 2. On the machine frame 32 a housing 33 is supported, through which a horizontally disposed shaft 34 extends which is journaled at one end in a diagrammatically indicated bearing 35, while its other end has a journal which is rotatably mounted in an additional diagrammatically indicated bearing 36 and is connected with a rotary drive 37 which serves only to rotate the shaft 34. Between the end walls of the housing 33 and inside of same a sieve wall 38 is stationarily disposed, which is similar to the sieve wall 4 of FIG. 1. In an upper part of the sieve wall 38 there is formed an opening to which a pipe 39 extending through the housing is connected, whose cross section can be closed and opened by means of a slide 40 which is mounted for movement by a diagrammatically connected cylinder-piston unit 41. The pipe 39 merges through an elbow with a pipe section parallel to the shaft 34 which is connected to the discharge end of a housing 42 of the conveyor screw 31 whose bottom consists of a sieve 43 under which a collecting trough 44 is disposed. The shaft of the conveyor screw 31 is disposed parallel to the shaft 34 and is connected to a rotary drive 45. Above the input end of the housing 42 is a loading hopper 46 by which the material 47 represented in dots is fed. The housing 42 is mounted on a column of the machine frame, which is not shown. The collecting trough 44 is connected by a conduit 48 to an additional collecting trough 49 which is underneath the sieve wall 38. Components 39 to 43 and 45 to 47 form an charging station.

On the shaft 34, as in FIGS. 1 and 2, a number of axially parallel press chambers 51*a* to 51*h* are formed between two end plates 50, and are preferably of identical size and shape, laterally defined by substantially radial dividers fastened on the shaft 34. Each press chamber 51 is separated by a membrane 52 into a pressure chamber 53 and press chamber 54, the membranes 52 preferably assuring that no equalization of pressure can take place between the pressure chambers 53 of the different press chambers 51. In the position shown in FIG. 5 the press chamber 51*b*is in the tube 39 and press chamber 51*h* is opposite a discharge station or opening indicated by an arrow v while press chamber 51*a* is in a so-called "zero" position, i.e., is not in use.

The feed of the pressure medium to the different pressure chambers 53 is performed according to FIGS. 3 to 6 by means of a distributing system 56 having, for example, a nonrotatably mounted distributor plate 57 and a distributor plate 58 which is coaxial therewith and with the shaft 34 and is rotatable with the latter. The distributor plate 58 has along a circle surrounding the axis of rotation of the shaft 34, at equal angular intervals, as many through-holes 59 (FIG. 4) as there are press chambers 51 at the periphery of the shaft 34. The distributor plate 57 also has holes in the same number, size and arrangement, which are connected to a pressure medium source, while each hole 59 in the distributor plate 58 is connected with one line 62 each. The shaft 34 is of hollow construction and is provided on its circumference with a bore which on the one hand leads into a corresponding pressure chamber 53 and on the other hand is connected each with one of the conduits 62 laid inside of the shaft 34. The angular spacing of holes 59 corresponds to the angular spacing of the pressure chambers 53. If therefore the shaft 34 is rotated stepwise, i.e., by an angle corresponding to this angular spacing by means of the rotary drive 37, each hole 59 of the distributor plate 58 rotating with it will come successively in line with all of the conduits 61 terminating at the nonrotatable distributor plate 57 and therefore will be connected upon each partial rotation with another of the lines 61. The pressure built up in any pressure chamber 53 depends therefore on the rotational position in which the shaft 34 finds itself and what pressure prevails in the corresponding conduit 61.

Figure 3:
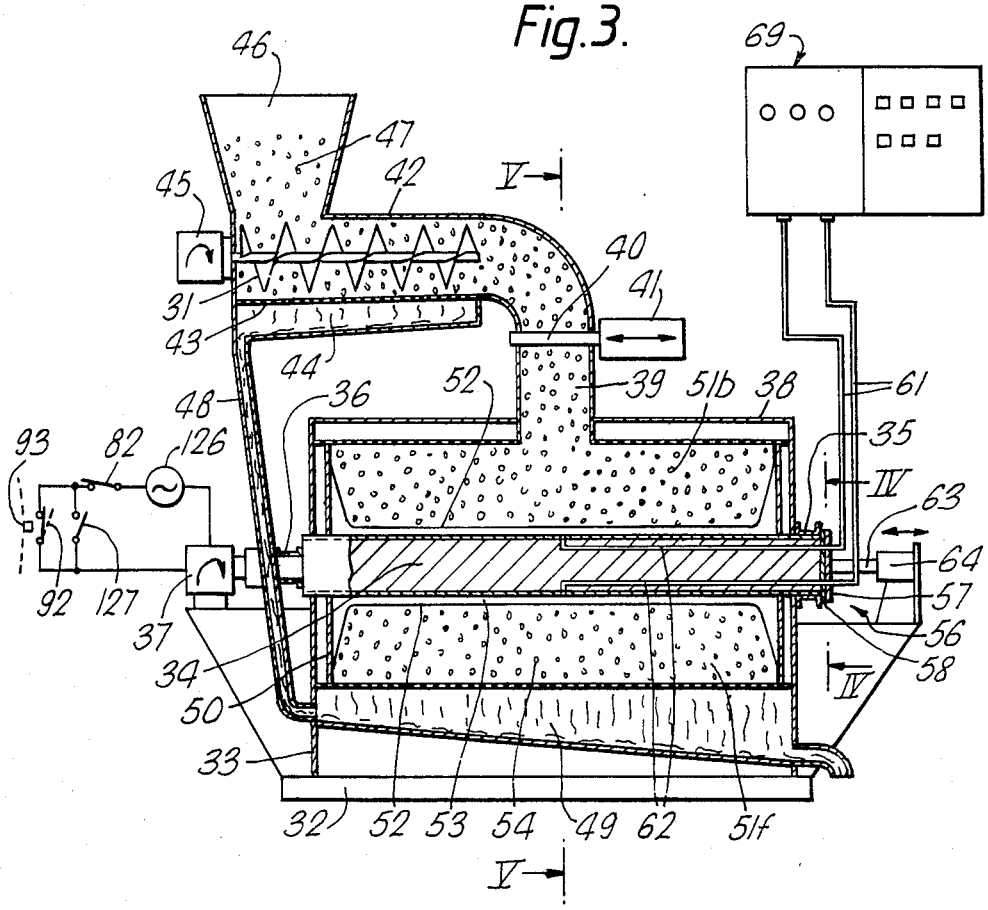

To prevent excessive friction from developing between the two distributor plates 57 and 58 during the phases in which the shaft 34 is advancing step-wise, the nonrotatable distributor plate 57 is preferably connected to the piston rod 63 of a pneumatic cylinder/piston system 64 fastened to the machine frame 32, so that, by the appropriate operation of same before each cycle of rotation in the direction of the double arrow represented in FIG. 3, it will be lifted away from the rotatable distributor plate 58 and can then be connected to it again in a leak-proof manner. During these turning phases the conduits 61 are preferably in the pressureless state.

Figure 6:
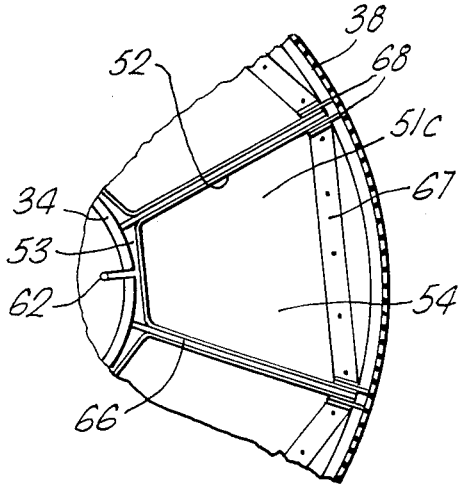
FIG. 6 is a variant of FIG. 5 greatly enlarged.

FIG. 6 shows a fragmentary section through the shaft 34 and the sieve wall 38. It can be seen that, as in the embodiments of FIGS. 1 and 2, radial dividers 66 are provided which define the individual press chambers 51 and form with the shaft 34 a rotatable, star-shaped carrier body. For the leak-proof fastening of the membranes 52 to these dividers 66, flat steel bars 67 serve which are fastened by means of screws or the like to the dividers 66 and end plates 50 and form substantially rectangular clamping rings which clamp the membranes 52 between them and the carrier body. For further sealing the portions of the membranes that come to be situated under the clamping rings can additionally be cemented, by means of a cement resistant to the pressure fluid, to the dividers 67, end plates 50 and flat steel bars 67.

The radial outer ends of the dividers 67 ought not to reach all the way to the inner circumference of the sieve wall 38 so as to prevent damage by friction. Instead, they have attached to them the preferably slightly flexible radially disposed wipers 68 in rubbing contact with the sieve wall 38, which, as the shaft 34 rotates, on the one hand prevent the passage of the material from one press chamber to the other, and on the other hand wipe down any material left clinging to the inside circumference of the sieve wall 38. These wipers 68 consist for example of Teflon, so that they wipe against the sieve wall 38 as the shaft 34 rotates, until minuscule gaps of 0.1 mm width have formed.

Figure 7:
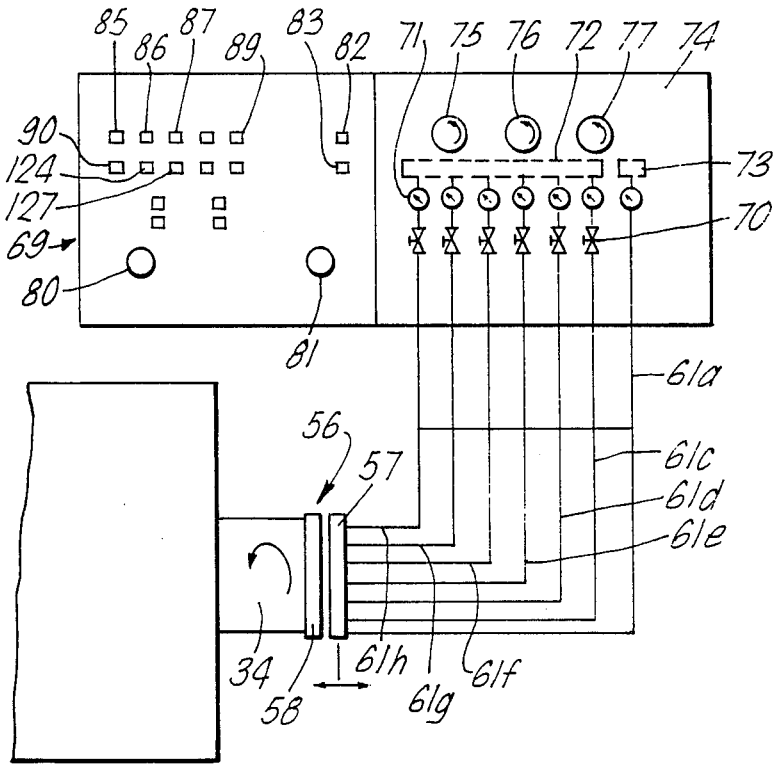
FIG. 7 is a diagrammatic view of a number of details necessary for the automatic operation of the press according to FIG. 3, FIGS. 8 to 10 are alternative embodiments of details of the presses according to FIGS. 1 to 7.

FIG. 7 shows diagrammatically a control system 69 which is suitable for the pneumatic control of the pressure in the various pressure chambers and for the electrical and/or pneumatic control of the other parts. In this special case it is assumed that a total of eight press chambers 51 are present as in FIG. 5, and therefore eight holes 59 are provided in the distributor plate 58, of which seven can be connected one to each of the lines 61*a* and 61*c* to 61*h*, while one hole 59 remains free. Each line 61*c* to 61*h* is connected through a valve 70, which is adjustable with the aid of a pressure gauge 71 and a knob, to a diagrammatically indicated pressure medium source 72, e.g., a compressor, and is therefore at a pressure depending on the setting of the valve 70, while the line 61*a* is connected with a diagrammatically indicated vacuum source 73, e.g., a pump. At a console 74 containing also the pressure gauges 71 there are also provided three adjustable time switches 75, 76 and 77 which can be set for selectable time intervals. The time switch 75 serves for example for setting the time for the activation of the rotary drive 45 of the conveyor screw 31, time switch 76 for setting the intervals of time during which the pressures set with the valves 70 are to be present in the lines 61*c* to 61*h*, and time switch 77 for setting the time interval during which the line 61 connected by tees to the lines 61*c* to 61*h* are to be at a preselected vacuum. In another section of the console 74 there are a number of switches for the independent electrical or pneumatic control of the different drives and cylinder/piston units, especially a main switch 80, an emergency switch 81, an on/off switch 82 for the rotary drive 37, and a switch 84 for the automatic operation of the entire press.

Figure 5:
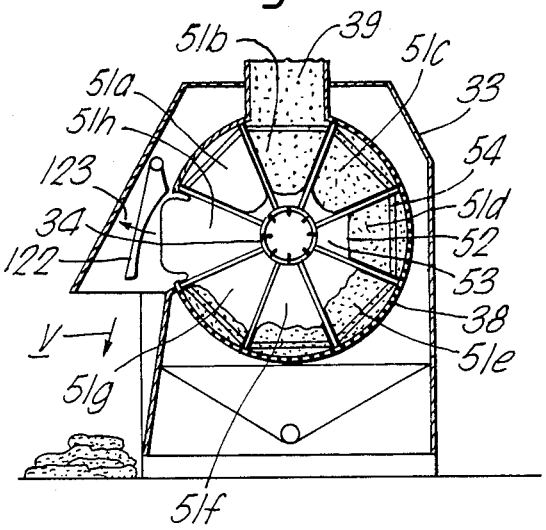

The operation of the press described in conjunction with FIGS. 3 to 6, when largely under manual control, is substantially as follows:

Let it be assumed that the press chambers 51*a* to 51*h* are in the basic position shown in FIG. 5. In this basic position the holes 59 in the distributor plate 58, which are connected to the pressure chambers of press chambers 51*c* to 51*h*, are aligned with the corresponding lines 61*c* to 61*h*.

The hole in distributor plate 58 that leads to the press chamber 51*b*, however, is associated with a vacant hole in the distributor plate 57, so that this pressure chamber is at normal pressure, while lastly the hole 51 that leads to the pressure chamber of press chamber 51*a* is connected with line 61*a*. Let it furthermore be assumed that the press chambers 61*c* to 61*h* are already filled, but press chambers 51*a* and 51*b* are empty.

If the press is used, for example, for pressing wine grapes, the valves 70 are adjusted so that, when the compressor 72 is turned on, pressures of 0.2, 0.5, 1.0, 1.5 and 2.0 bars above atmospheric will be present in lines 61*c* to 61*g*, respectively, i.e., increasing pressures. The valve 70 in line 61*h* is adjusted so that, when the compressor 72 is turned on, a pressure of 0.5 bar is present. The vacuum pump 73 connected to line 61*a* supplies a vacuum of, for example, 0.3 bar.

After the main switch 80 is turned on, the cylinder/-piston system 41 is activated by means of a switch 85 and thus the slide 40 is retracted. By means of an additional switch 86, the rotary drive 45 of the conveyor screw 31 is turned on, until the press chamber 51*b* underneath the pipe 39 is filled. Then the conveyor screw is turned off and the slide 40 is pushed forward again, concluding the filling of the press chamber 51*b*. During the filling operation, furthermore, the cylinder/piston system 64 is turned on to advance the distributor plate 57, and then the compressor 72 is turned on with a switch 85 to produce in the pressure chambers 53 the pressure set by the valves 70. Thus the press chamber 51*h* that is at the discharge station is discharged, while pressing is done in the other press chambers 51*c* to 51*g*. Thus the membranes 52 are gradually made to bulge outward in the manner seen in FIG. 5, and the material in them is pressed against the sieve wall 38. The liquid thus pressed out runs down on the outside of the sieve wall 38 and drips directly into the collecting trough 49.

After a preselected pressing time of, for example, several minutes the switch 87 is again actuated to turn off the compressor 72. With another switch 89, the vacuum source 73 connected to line 61*a* is turned on to produce a vacuum in the press pressure chambers 53 of all press chambers 51*a* and 51*c* to 51*h* and to retract their membranes 52 until the material present in the press chambers 54 is relieved of pressure, and during the next rotation of the shaft 34 no very great friction resistance will be produced. After a preselected period of time, which depends especially on the nature, e.g., the stiffness of the membrane material, this operation is terminated.

Now the vacuum source 73 connected to the line 61*a* is shut off, while switch 90 is used to turn on the cylinder/piston system 64 to retract the distributor plate 57. Then the rotary drive 37 of the shaft 34 is turned on with switch 82 so that the shaft rotates and with it the press chambers 51. This operation is ended as soon as the press chamber marked 51*a* in FIG. 5 has advanced precisely one division in the direction of the arrow and is located under the pipe 39, i.e., assumes the position previously assumed by the press chamber 51*b*. In like manner, all the other press chambers have thus advanced by precisely one division, so that the press chamber 51*h* is now in the position previously held by press chamber 51*a*. Since the distributor plate 58 has also advanced with shaft 34 by precisely one division, while the distributor plate 57 was not rotated, all holes of the two distributor plates 57 and 58 are again paired in alignment with one another after switch 90 has been reactuated to advance the distributor plate 57.

The operation described can now be continued by actuating the switches 85 and 86 in the same manner. Since the distributor plates 57 and 58 have advanced relatively to one another by exactly one division, the pressure chamber of the press chamber in position 51*b* in FIG. 5 is always without pressure, while the pressure chamber of the press chamber in position 51*h* in FIG. 5, for example, can be pressurized always with only the pressure selected for the discharge of the pressed material. The material that is in any press chamber is therefore pressed successively in steps with increasing pressures (positions 51*c* to 51*g*) and then discharged before the particular press chamber again reaches the pipe 39. The press chamber in position 51*a* in FIG. 5 remains always empty and can therefore be connected only with the vacuum pump 73. Since consequently its membrane has been withdrawn before the shaft 34 advances, this membrane, upon reaching position 51*b* in FIG. 5, is already in the desired position for the filling operation. Since lastly the press chamber that is in position 51*b* in FIG. 5 serves only for the filling operation, but not for the pressing operation, no pressure or vacuum line is associated with it, with the sole exception of the unoccupied hole in the distributor plate 57.

A special advantage of the described press is that different pressures can be provided in the individual press chambers 51, which results in a gentle but complete expression of the liquid from the material. In particular, a preliminary pressing at low pressure can first be performed in press chambers 51*c* and 51*d*, then a main pressing at medium pressure in press chambers 51*e* and 51*f*, and lastly a final expression at high pressure in press chamber 51*g*. All that is necessary for this purpose is, as described above, to seal the different pressure chambers 53 hermetically against one another in order to largely prevent any equalization of the pressure.

The switches, timers etc. described in conjunction with FIG. 7 are preferably connected to a stepping mechanism disposed underneath the console 74, by which the different working steps can be performed automatically one after the other when the switch 83 is set for automatic operation. In this case a single operation of switch 83 will suffice to make the press operate automatically for any desired length of time. Then, by means of the time switches 75, 76 and 77, it is necessary only to set the desired cycling times for the conveyor screw 31, the pressing time, and the time to be allowed for emptying before advancing the shaft 34. The controlling of the rotation of the shaft 34 by precisely one step each time is performed by means of a limit switch 92 (FIG. 4) which is fastened to the machine frame and cooperates with a number of cams 93 which are disposed on the outer circumference of the co-rotating distributor plate 57 at angular intervals corresponding to those of the press chambers 51, i.e., to the particular division. The limit switch 92 is wired into the circuit of the rotary drive 37 and stops it after each step.

It would also be possible to provide an only partly automatic control. The control of the step-wise rotation of shaft 34 might be performed by means of the circuit represented schematically in FIG. 3 which is connected to the rotary drive 37 in the form of an electric motor. The one terminal of the rotary drive 37 is connected through a voltage source 126, the switch 82, and the limit switch 92, to the other terminal of the rotary drive 37. Furthermore, the limit switch 92 is shorted by a momentary contact switch 127 which is normally held in the open state by a spring, while the limit switch 92 is normally held in the closed position by a spring. If switch 82 is closed, the shaft 34 will rotate until one of the cams 93 opens the limit switch 92, or remains in the rest position when the limit switch 92 has already been opened by a cam 93. If the shaft 34 is then to be advanced by one step, the momentary contact switch 127 is briefly closed until the cam 93 moves away from the end switch 92 and the latter again closes. When the next cam 93 reaches the limit switch the momentary contact switch 127 has already opened, so that the shaft 34 comes to a stop after precisely one stepping movement.

The control of the embodiments according to FIGS. 1 and 2 can be performed in like manner. It is necessary only to note that no empty chamber corresponding to press chamber 51*a* is present, i.e., one more pressure line 61 is needed (FIG. 1), or that two adjacent press chambers are filled virtually simultaneously and therefore these pressure chambers can remain constantly at standard pressure (FIG. 2).

Figure 8:
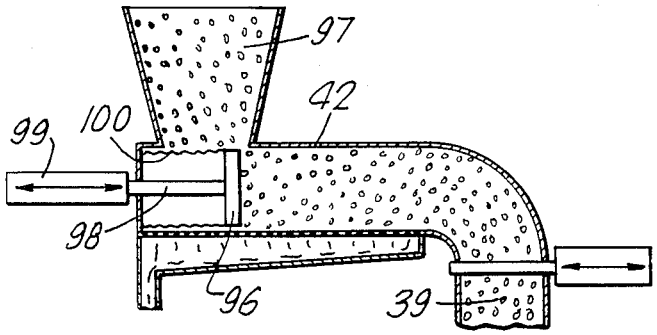

FIG. 8 shows an embodiment in which the positive feeding of the material to the press is performed with a pusher 96 instead of with a screw conveyor. The pipe 39 and the housing 42 are constructed as in FIG. 3. The material is fed to the housing 42 by means of a hopper 97. The pusher 96 is displaceably mounted in the housing 42 and connected by a plunger rod 98 carried through an end wall of the housing 42 to a cylinder/piston system 99. The material is fed to the pipe 39 by operating the cylinder/piston system 99, while a considerable amount of liquid is drawn from the material before it reaches the press chambers, as it is when a screw conveyor is used. To prevent the material from penetrating into the space behind the pusher 96, the latter is best connected to a flexible bellows 100 fastened to the housing, which covers the space under the hopper 97 when the pusher 96 is advanced.

Figure 4:
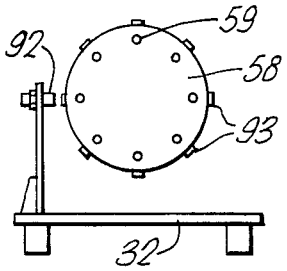
FIGS. 4 and 5 are cross sections along lines IV—IV and V—V of FIG. 3.
Figure 9:
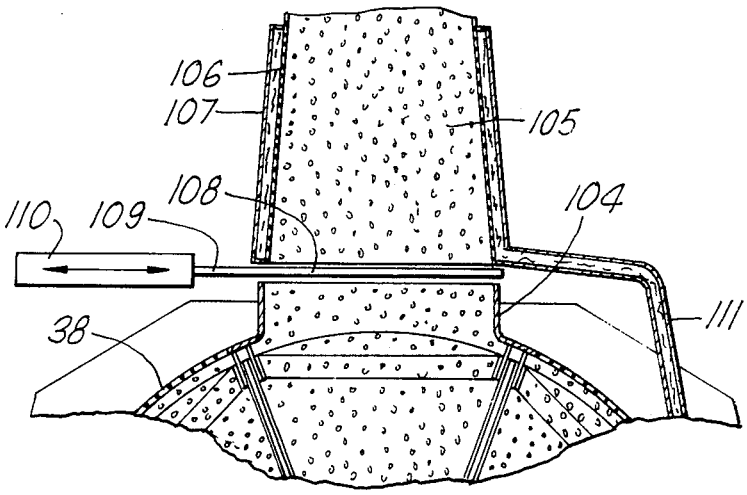

In the embodiment according to FIG. 9, the sieve wall 38, made substantially as in FIGS. 3 to 5, has a charging station in the form of an upper connection 104 and a hopper 105 adjoining it which flares toward the connection 104 and has an inner jacket 106 in the form of a sieve and solid outer jacket 107 surrounding the latter. At the bottom end of the hopper 105 there is a slide 108 which is connected to the plunger rod 109 of a cylinder/piston system 110 and can open and close the cross section of the hopper according to how it is operated. The liquid flowing by gravity out of the material in the hopper is collected in the space between the inner jacket and outer jacket 106 and 107, respectively, and carried away by a line 111. In contrast to the other embodiments described, there is thus no positive feeding of the material to the press chambers. In any case the filling of the press chambers is facilitated considerably, even in the case of sticky or easily bridging materials, by the fact that the hopper 105 flares downwardly.

Figure 10:
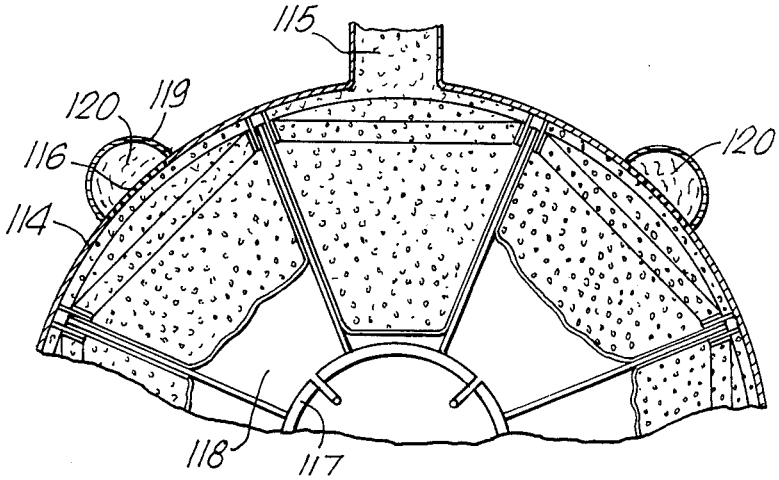

FIG. 10 shows an embodiment which is especially suited for expressing juice from wine grapes for the production of red wine. In this case it is desirable to let the crushed grapes stand for several days in a sealed vessel and to press them afterward. FIG. 10 shows a sieve wall 114 for this purpose, which can be constructed substantially as in FIG. 9 and has a filling connection 115 which can be connected with a hopper. In contrast to the other embodiments, the sieve wall 114, however, has only a few sieve-like sections 116 while the rest of the surface is solid, the sieve sections 116 being disposed along the circumference of the sieve wall 114 at approximately the same angular intervals as the press chambers 18 fastened on a shaft 117. On the outside of the sieve sections 116 are provided hood-like covers 119 which are affixed to the outer circumference of the sieve wall 114 and form enclosed collecting channels 120 for the liquid pressed out in the pressing operation. The covers 119 are either provided with removable caps or with a common, likewise sealable collecting pipeline. The advantage is thus achieved that the press can be used as a holding tank that is virtually hermetically sealed in order to let the crushed grapes stand for a few days with low oxidation, and on the other hand it can be used for pressing the grapes without the necessity of transferring them from another tank to the press. For the pressing operation it is necessary only to see to it that the juice collecting in the channels 120 is able to flow out.

An especially important procedure in the pressing of substances containing liquids is known as "crumbling." This refers to the loosening up or crumbling of the already compressed material between the individual pressings. When the presses according to the invention are used, this crumbling can be achieved simply by revolving the shafts 16 and 34 and 117 with the press chambers fastened thereon one or more times through a full revolution between the individual pressings. The rotation, and the preferably present wipers 68 (FIG. 6), or even the dividers reaching the sieve wall of the press chambers, will provide for a sufficient loosening up of the material. In the case of automatic control of the press, provision can be made for the shaft bearing the press chambers to be turned first at least one full revolution between two cycle steps and after the end of a pressing, after all the membranes have been retracted. To prevent the material from being ejected uncontrolledly through the discharge openings, the latter can be provided with flap doors or sliding doors which are closed by cylinder/piston systems before the crumbling. In FIG. 5 a flap door 122 is diagrammatically indicated, which can be opened and closed in the direction of an arrow 123 by a cylinder/piston system, as in the case of the manual control of the press as described above, for example by means of an additional switch 124 (FIG. 6). If crumbling is not necessary, the flap 122 can remain constantly open, as it was assumed to be in the above explanation of the manner of operation.

The invention is not limited to the embodiments described above, which can be modified in many ways. This is especially true of the apparatus used for automatic control of all operations, but also of the number and arrangement of the press chambers, charging and discharge openings, and the apparatus used for feeding the material from the hopper to the press chambers. Also the pressures in the various lines and pressure chambers, which are given only by way of example, can be adapted in any desired manner to the material used in any particular case. Furthermore, it is not essential to perform a positive feed of the material to the press chambers or any kind of preliminary juice extraction with the means described in conjunction with FIGS. 1 to 3, 8 and 9. The screw conveyors 3, 3*a* and 31, and the pusher 96 do, however, offer the special advantage that the bulk of the material can be substantially reduced before it enters the press chambers, so that overall a considerable increase in efficiency is achieved, and the entire press including the positive feed can be made and operated as a small, compact, integrated unit which requires but little space. Lastly, it would be conceivable to provide for cycle steps and/or divisions of different magnitude as regards the press chambers, although the constant division represented and the selection of cycle steps of the same size are especially advantageous.

The sieve walls 4, 38 and 117 have holes whose diameter in the processing of wine grapes amounts to, for example, 2 mm. In the processing of other substances, however, larger or smaller holes can be provided. Furthermore, instead of round holes, holes of different shapes, especially triangular shapes or slots can be provided. It is furthermore possible to utilize only a few of the press chambers present for the pressing operation, especially when, in the case of automatic operation for example, the total amount of the crushed grapes is smaller than the working capacity of the press. Lastly, the individual operations could be separated from one another, for example by first pressing, then vacuuming, then filling and dumping, then turning ahead, and then repeating the operation.

We claim:

1. A press for pressing out material in the form of liquid-containing substances, especially musts comprising:

(a) a frame;

(b) carrier means having an axis, being rotatably mounted on said frame and having dividers extending radially to said axis, said dividers forming a plurality of press chambers, said press chambers being sealed against each other and being circumferentially spaced around said axis;

(c) a stationary, at least partially cylindrical sieve wall circumferentially surrounding said carrier means and having at least a plurality of sieve segments and two openings, said sieve segments and said openings being circumferentially spaced around said axis;

(d) radially movably press means disposed in said press chambers and dividing said press chambers into pressure chamber portions disposed radially inwardly, and into press chamber portions disposed radially outwardly and being open radially outwardly;

(e) a charging station coupled to one of said openings of said sieve wall for filling the material into said press chamber portions;

(f) a discharging station coupled to the other one of said openings of said sieve wall for emptying said press chamber portions of the material;

(g) drive means for rotating said carrier means and for placing thereby said press chambers at said charging station or said discharging station, respectively; and (h) moving means for moving said press means at least radially outwardly and for pressing the material filled into said press chamber portions against said sieve wall.

2. A press according to claim 1, comprising control means for controlling said moving means such that said press means are moved outwardly with different pressures.

3. A press according to claim 2, wherein said control means is adjustable such that said moving means is movable with increasing pressure during rotation of said press chambers with said carrier means from said charging station to said discharging station.

4. A press according to claim 1, wherein said charging station comprises pre-de-juicing means disposed outwardly of the sieve wall for gently pre-de-juicing the material substantially without pressure.

5. A press according to claim 4, wherein said pre-de-juicing means comprises feeding means for positively feeding said material to said one opening of said sieve wall.

6. A press according to claim 5, wherein said feeding means comprises a screw conveyor.

7. A press according to claim 1, wherein all of said press chambers have the same width measured circumferentially of said axis, and wherein said charging station is at a measured distance from said discharging station circumferentially of said axis, said measured distance being an integral multiple of said width.

8. A press according to claim 7, wherein the distance of said charging station from said discharging station corresponds to no more than the width of one press chamber.

9. A press according to claim 7 or 8, wherein said drive means is a step-drive for rotating said carrier means in steps, each step corresponding to the width of one press chamber.

10. A press according to claim 2, wherein said carrier means is mounted on a hollow shaft having holes, and wherein said moving means has a number of conduits disposed within said shaft and associated with said holes, distributor means connected to said conduits, lines connected to said contributor means, and pressure and vacuum source means coupled to said lines.

11. A press according to claim 10, wherein said distributor means comprises two coaxial distributing plates, one of said plates being fastened to one end of said shaft, and the other plate being non-rotatably disposed within said frame, both plates having holes which are disposed on a circle surrounding the axis of rotation of said shaft in a spacing corresponding to the width of one press chamber, said holes after each rotation of said carrier means by an amount corresponding to the width of one press chamber, being aligned with one another.

12. A press according to claim 1, wherein said openings of said sieve wall form interruptions thereof extending circumferentially around said axis.

13. A press according to claim 1, wherein said sieve wall is a continuous sieve wall except for said openings.

14. A press according to claim 12, wherein said sieve wall is a continuous wall except for said interruptions.

15. A press according to claim 1, wherein said press means are flexible or elastic membranes affixed to said dividers, said moving means comprising means for feeding a pressurized medium into said pressure chamber portions.

16. A press according to claim 15, wherein said membranes are affixed to said dividers such that said pressure chamber portions are sealed by said membranes form said press chamber portions.

* * * * *